United States Patent [19]

Palm et al.

[11] Patent Number: 4,534,706

[45] Date of Patent: Aug. 13, 1985

[54] SELF-COMPENSATING OSCILLATORY PUMP CONTROL

[75] Inventors: Richard R. Palm, Fullerton; Robert G. James, Whittier; Robert E. Fisher, Los Nietos, all of Calif.

[73] Assignee: Armco Inc., Middletown, Ohio

[21] Appl. No.: 468,341

[22] Filed: Feb. 22, 1983

[51] Int. Cl.[3] ..... F04B 49/00

[52] U.S. Cl. ..... 417/17; 417/22; 417/42; 417/415; 74/89.2; 74/89.22; 74/590; 318/282; 318/467

[58] Field of Search ..... 417/1, 12, 17, 15, 22, 417/18, 42, 44, 45, 53, 63, 223, 410, 415, 43; 74/89.2, 89.22, 589, 590; 318/259, 282, 286, 326, 467, 468; 92/137

[56] References Cited

U.S. PATENT DOCUMENTS

| | | | |
|---|---|---|---|
| 1,927,831 | 9/1933 | Hild | 318/282 |
| 3,065,704 | 11/1962 | Hill | 318/282 X |
| 3,295,038 | 12/1966 | Trottman | 318/281 X |
| 3,306,210 | 2/1967 | Boyd et al. | 417/1 |
| 3,344,327 | 9/1967 | Hutchinson et al. | 318/282 X |
| 4,062,640 | 12/1977 | Gault | 417/415 |
| 4,145,161 | 3/1979 | Skinner | 417/53 X |
| 4,179,947 | 12/1979 | James | 74/591 X |
| 4,197,766 | 4/1980 | James | 74/89.2 |
| 4,234,833 | 11/1980 | Barrett | 318/282 |
| 4,326,837 | 4/1982 | Gilson et al. | 417/45 X |
| 4,339,699 | 7/1982 | de Jonge et al. | 318/561 |
| 4,364,111 | 12/1982 | Jocz | 318/286 X |
| 4,367,435 | 1/1983 | Bailey et al. | 318/258 X |
| 4,404,863 | 9/1983 | James | 417/415 X |
| 4,476,418 | 10/1984 | Werner | 417/415 X |

*Primary Examiner*—William L. Freeh
*Assistant Examiner*—Paul F. Neils
*Attorney, Agent, or Firm*—Frost & Jacobs

[57] ABSTRACT

A microprocessor based control system for establishing the optimum points of motor turn on and turn off for an oscillatory pumping system. The power to the motor is disabled at a point calculated to return the maximum stored mechanical energy to the system after turn-around. The motor is restarted at either a predetermined motor speed which may be different in the up and down stroke directions, or when the speed peaks. Safeguards are also provided under control of the microprocessor for disabling pump operation in the event of pump overtravel, overload or pump off. The control permits dynamic changes to the operating parameters of the pumping system in order to optimize the power required by the motor over a wide range of operating conditions.

23 Claims, 17 Drawing Figures

SELF-COMPENSATING OSCILLATORY PUMP CONTROL

SUMMARY OF THE INVENTION

The present invention is directed to a control system for an oil well pump, and more particularly to a self-adjusting control for the type of oscillatory pump described in U.S. Pat. Nos. 4,179,947 and 4,167,098.

With this type of pump, a pair of mandrels is supplied on a rotatably supported shaft. Each of the mandrels has wound thereabout in a spiral wind up, a length of sheave chain. The free end of one of the sheave chains extends into a well bore to support a pump rod in its lower end. The end of the other sheave chain also extends into a bore and supports at its end a counterbalance. Since the sheave chains are wound in opposite directions, one of the chains winds up as the other unwinds. This results in an oscillatory motion as the moment around one mandrel overcomes the kinematic moment of the other mandrel. A reversible electric motor is connected to the shaft to overcome the frictional losses and work in the well bore.

The present invention is directed to a control system for continuously optimizing the starting and stopping points of the electric motor. The control system is under the supervision of a microprocessor which monitors the position and other operating parameters of the pumping system, and supplies suitable control signals for starting, stopping and reversing the electric motor at the points calculated to insure the most efficient operation.

The control system includes means to disable power drive to the motor at a reference position in the pump stroke. This reference position is determined initially by an electromechanical reversal switch activated at the upper or lower limit of the pump stroke. The actual position of the pump rod as sensed by an electromechanical or electronic counter is also stored in memory and continually updated to deactivate motor drive at the exact point calculated to produce the most efficient turn-around characteristic in view of the particular pump load at that specific moment.

Means are also provided for reversing direction of pump member travel in the form of an electromagnetic gang switch which reverses the primary power supplied to the motor independently of the motor stopping or starting characteristics. The starting characteristic of the motor is controlled by a power ramping unit which produces a controlled current start to the motor. Both the reversing and controlled start-up functions are under control of the microprocessor.

Following reversal of the motor, means are also provided for establishing an optimum motor speed. This is determined by starting the motor only when motor speed following reversal reaches a predetermined value, or when the motor speed following reversal has reached a peak. In the former case, a different threshold motor speed value is established for stroke travel in the up and down directions to compensate for the different mechanical actions of the system.

The microprocessor also automatically adjusts the reference position so that the motor speed following reversal approaches the optimum motor speed to insure that the motor is turned on at the proper point.

Other automatic safeguards are also built into the control system such as electromechanic limit switches for preventing pump overtravel, means for preventing the pump from accidentally driving into the upper or lower limit, and means for disabling pump operation in the event that the motor is overloaded or a pump off condition is sensed.

As will become apparent from the detailed description which follows, the control of the present invention permits dynamic changes to the operating parameters of the pumping system, particularly with regard to the motor speed and reversal points, in order to optimize the power required by the motor over a wide range of operating conditions. In the automatic mode of operation, the reversal points are continually updated based on the load encountered by the motor to insure that maximum advantage is taken of the inherent stored energy of the mechanical components of the oscillating pump system.

DETAILED DESCRIPTION

Figure 1:
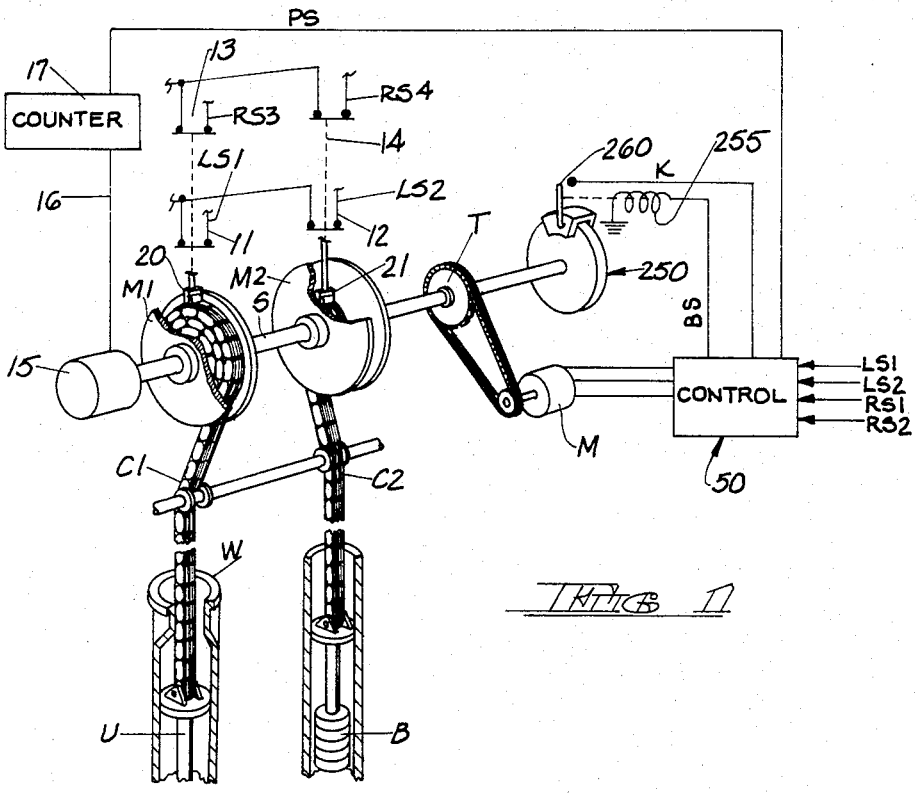
FIG. 1 is a partially schematic perspective view of the oscillatory pumping system used with the control of the present invention.

FIG. 1 illustrates the type of counterbalanced pumping assembly described in U.S. Pat. Nos. 4,179,947 and 4,167,098. A first mandrel M1 is mounted on a common shaft S which also supports a second mandrel M2. Shaft S is geared through a sprocket arrangement T or otherwise connected to an electrical motor M which thus drives both mandrels M1 and M2 in rotation. As will be described hereinafter, motor M is operated by a control, shown generally at 50. Mandrel M1 has wound thereabout, in a spiral wind-up, a length of sheave chain C1 which extends into the interior of a well bore W to support at its end a pump rod U. Mandrel M2 in a similar manner, winds up a sheave chain C2 in the opposite direction which at its free end supports a counterbalance B. Since the sheave chains are wound in opposite directions, as one sheave chain unwinds, the other increases its moment arm. Thus as the pump descends into the interior of the well bore W the moment arm supporting the counter-balance B increases. This results in oscillatory motion as the moment around one mandrel overcomes the kinematic moment of the other mandrel. Because the frictional losses in the sheave chain are practically negligible, a pump of this kind will tend to oscillate as long as the work in the well bore is minimized.

Figure 2:
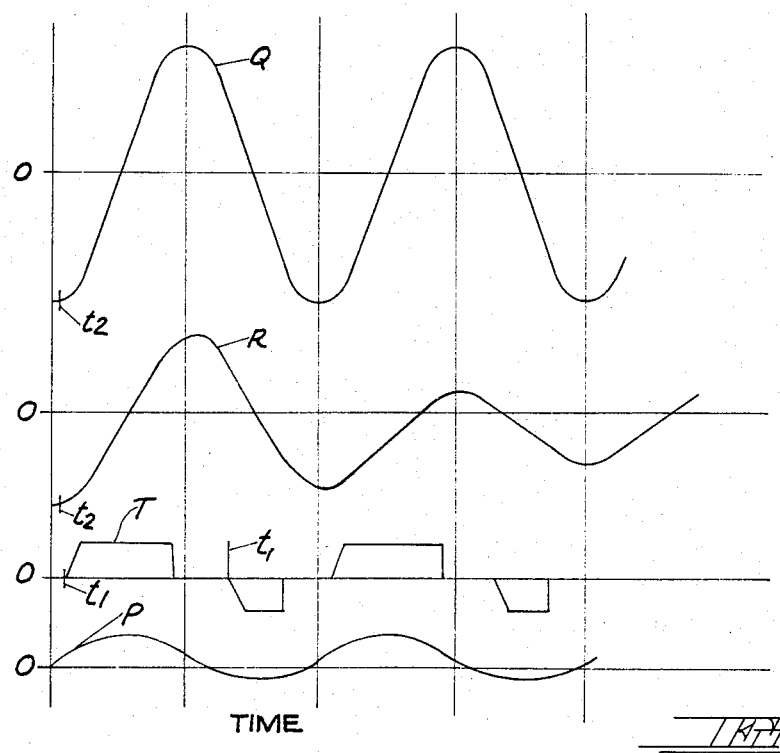
FIG. 2 is a graphical representation of motions and power levels incident to the operation of the pumping system of FIG. 1.

Referring to FIG. 2, the foregoing configuration, when idealized, i.e., undamped, will result in a sinusoidal position or potential energy curve Q which has a period and frequency characteristically determined by the moment of inertia of the mandrels, the weight of the chains and the various components suspended therefrom. Once the components of friction and the work entailed of bringing the oil to the surface are added, a skewed curve R, describing a damped and skewed sinusoidal function as distorted by the effect of the oil in the well, provides the actual or loss inclusive waveform. The net power input necessary to maintain the peak amplitude constant, shown herein as a curve P, is therefore the difference between the two curves Q and R, having a larger area above the zero line attributable to the work entailed in lifting the oil to the surface. It is to be noted that the power demand starts at zero—zero initially and therefore at each crossing full power is not necessary. It is for this reason that a ramped power input is incorporated herein, as shown in curve T, which when integrated with time has the same area as that under curve P. It will be understood, however, that the curves shown are highly linearized for purposes of clarity. It is to be noted that curve P does not necessarily start at zero—zero and may occur a time interval $t_1$ later. Thus power may be applied to motor M some time after the sinusoidal peak (i.e. outside of time aperture $t_2$). This time period may thus be dedicated to switching reversal and power-off functions.

Referring to FIG. 1, mandrels M1 and M2 may be aligned subjacent normally closed limit switch assemblies 11 and 12 deployed to produce two limit switch signals LS1 and LS2, respectively, which are provided as inputs to control 50. These limit switches will thus sense extraordinary strokes (overtravel) which indicate a failure and immediately cause primary power to motor M to be interrupted.

A pair of reversing switches 13 and 14 are also provided to produce reversing signals RS3 and RS4, respectively, to indicate the nominal upper and lower reversal points of the pump rod U. It will be understood that upper limit switch 11 and upper reversing switch 13 are both operated by means of a common cam 20 which rides on the upper surface of sheave chain C2, reversing switch 13 being activated before limit switch 11. Similarly, lower limit switch 12 and lower reversing switch 14 are activated by a common cam 21 which rides on the outer surface of sheave chain C2, reversing switch 14 being activated before limit switch 12.

The system is also provided with a tachometer 15 which provides a series of electrical pulses on line 16 representative of the position of shaft S. For example, tachometer 15 may represent a magnetic pick-up which senses the proximity of teeth on a gear non-rotatably attached to shaft S. For each increment of angular rotation of the gear, a single pulse will be produced by the magnetic pick-up on line 16.

Electrical pulses appearing on line 16 may be provided to a counter 17 which produces a count or position signal PS which is indicative of the actual position of pump rod U. Position signal PS is applied as an input to control 50 as will be explained in more detail hereinafter.

Figure 3:
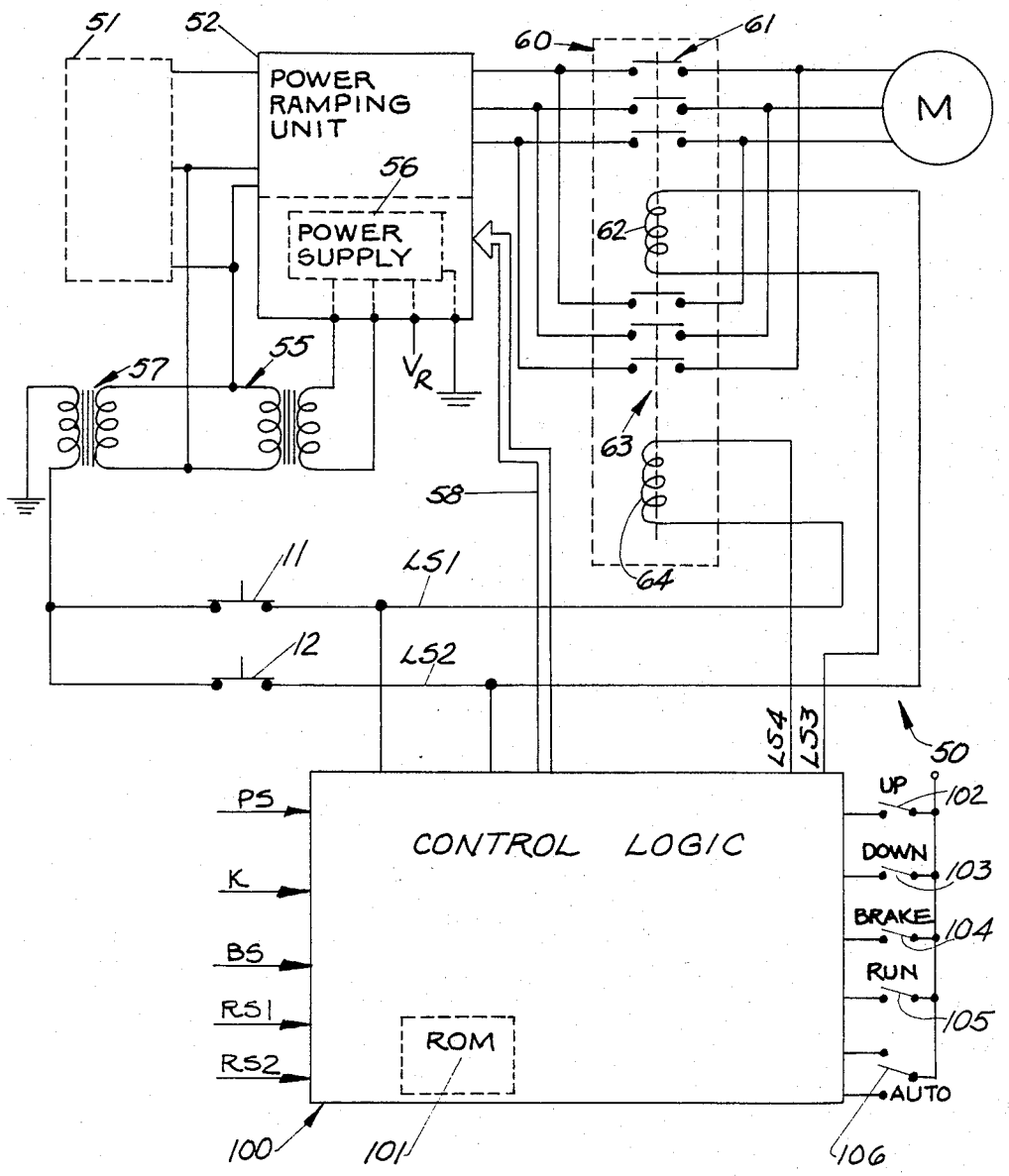
FIG. 3 is a schematic block diagram of the control system of the present invention.

As can be seen in FIG. 3, control system 50 receives its primary electrical power from a conventional three phase source 51 connected to a power ramping unit 52 such as that supplied under the trademark "STARTROL" by the Motor Control Corporation, Anaheim, Calif. It is to be understood, however, that the reference to the "STARTROL" type of unit is exemplary only, and other shaping units may be used herein. Control signals for enabling or disabling the power ramping unit, as well as for controlling the slope of the power up ramp are carried on line 58 from control logic 100. Two of the three leads from the source 51 are tapped off to a transformer assembly 55 which provides all the necessary power for power ramping unit 52. Assembly 55 includes transformer 57 having one leg thereof connected to a common and the other leg connected through the aforementioned normally closed limit switches 11 and 12 (located externally of control 50) to a reversing switch assembly 60. The three power lead outputs from power ramping unit 52 are connected to the motor M across reversing switch assembly 60.

The reversing switch assembly 60 comprises an upper switch gang 61 connected for magnetic pull-in by a coil 62 excited by the signal LS3, which serves to drive motor M in the down direction, and a lower switch gang 63 pulled in by a coil 64 excited by the signal LS4, which serves to drive motor M in the up direction. Switch gangs 61 and 63 include three switch connectors closing the circuit across the three power leads to the motor M.

Because the switch assembly 60 is thus operated by independent signals LS3 and LS4, the switch-over is independent of the power output to the motor and can occur at a time when the motor is just simply coasting, as long as the coast is within the limits sensed by the limit switches. In this mode the contacts of the switch gangs 61 and 63 carry no current at the time of switchover, extending the contact life. The circuit including coils 62 and 64 further include control logic 100 which, in response to the signal from sensor 15 and counter 17 initiates the power ramping unit 52 after the switchover, as described in more detail hereinbelow. Accordingly, the circuit is completed across the foregoing pull-in coils only during such times as the limit switches are closed.

As shown in FIG. 1, a brake 250 may be installed on shaft S and engaged electromagnetically through a coil 255 under control of a signal BS from control 50. Brake application can occur at any point on the stroke or at any point in the stroke. Once the brake is latched, a signal K is produced through a contact 260 and is applied as an input to control 50.

The control 50, and ultimately motor M, are supervised by a control logic 100, which may be a processor such as a digital computer, and more particularly a microprocessor. As will be explained in more detail hereinafter, control logic or processor 100 receives input signals representative of the operating state of the motor M and pumping assembly illustrated in FIG. 1, and provides outputs to the switch assembly 60, and power ramping unit 52 to control the starting and stopping of motor M at the optimum point in the pumping cycle in order to adjust the stroke length to optimize motor operation.

Figures 4A, 4B:
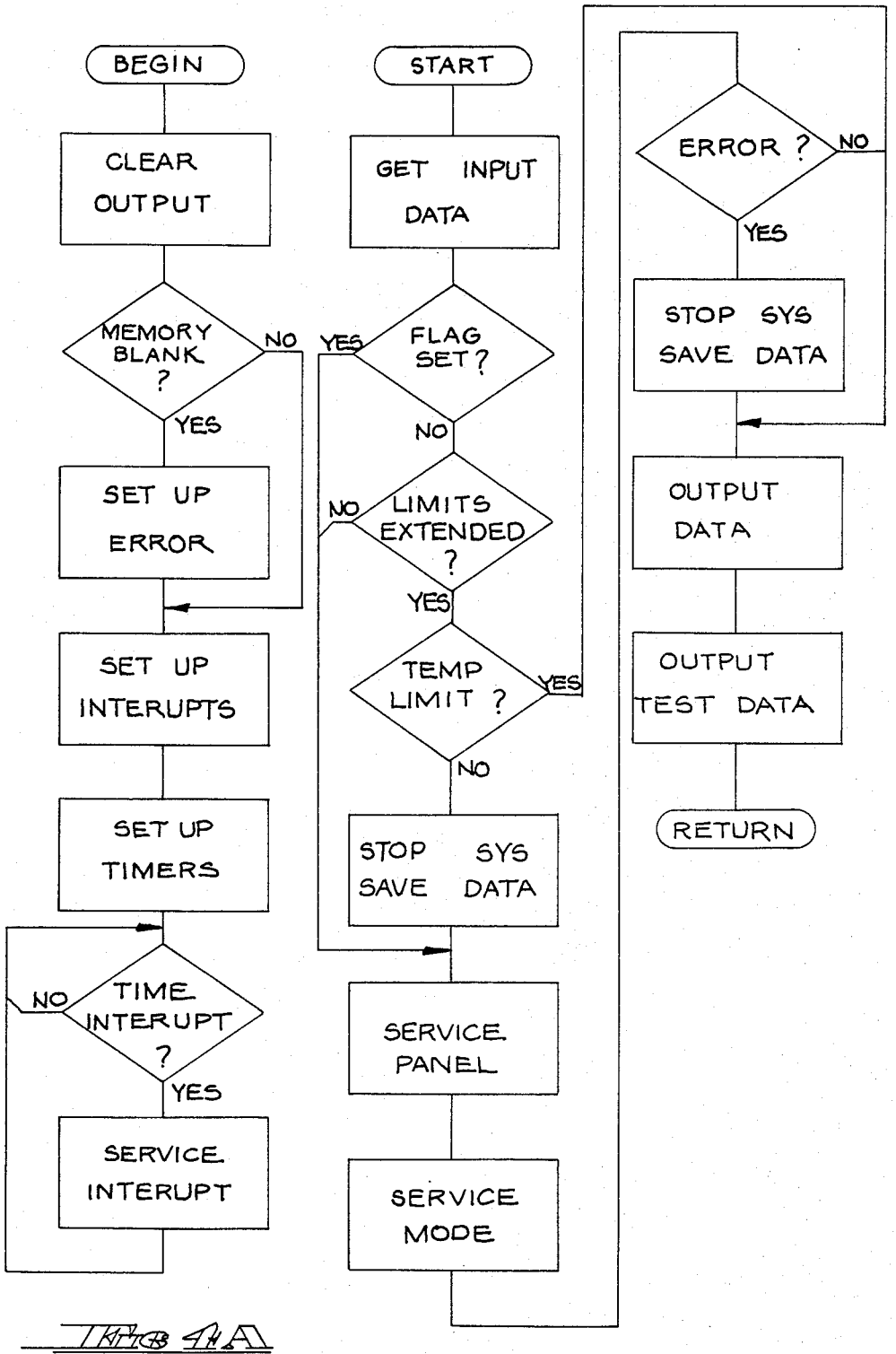
FIG. 4A–FIG. 4N are flow diagrams illustrating the processing used with the microprocessor control of the control system of FIG. 3.
Figure 4C:
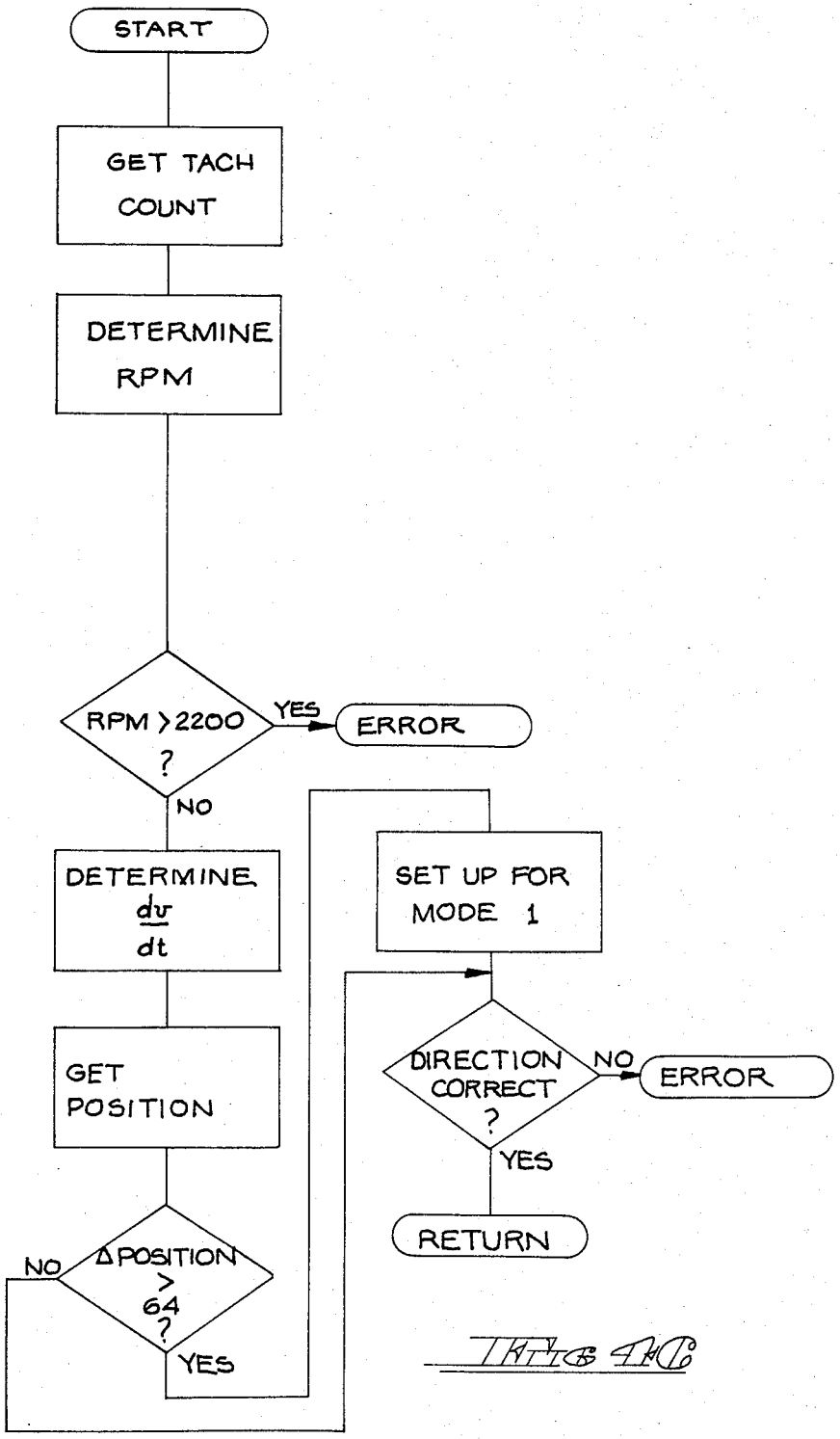
Figure 4D:
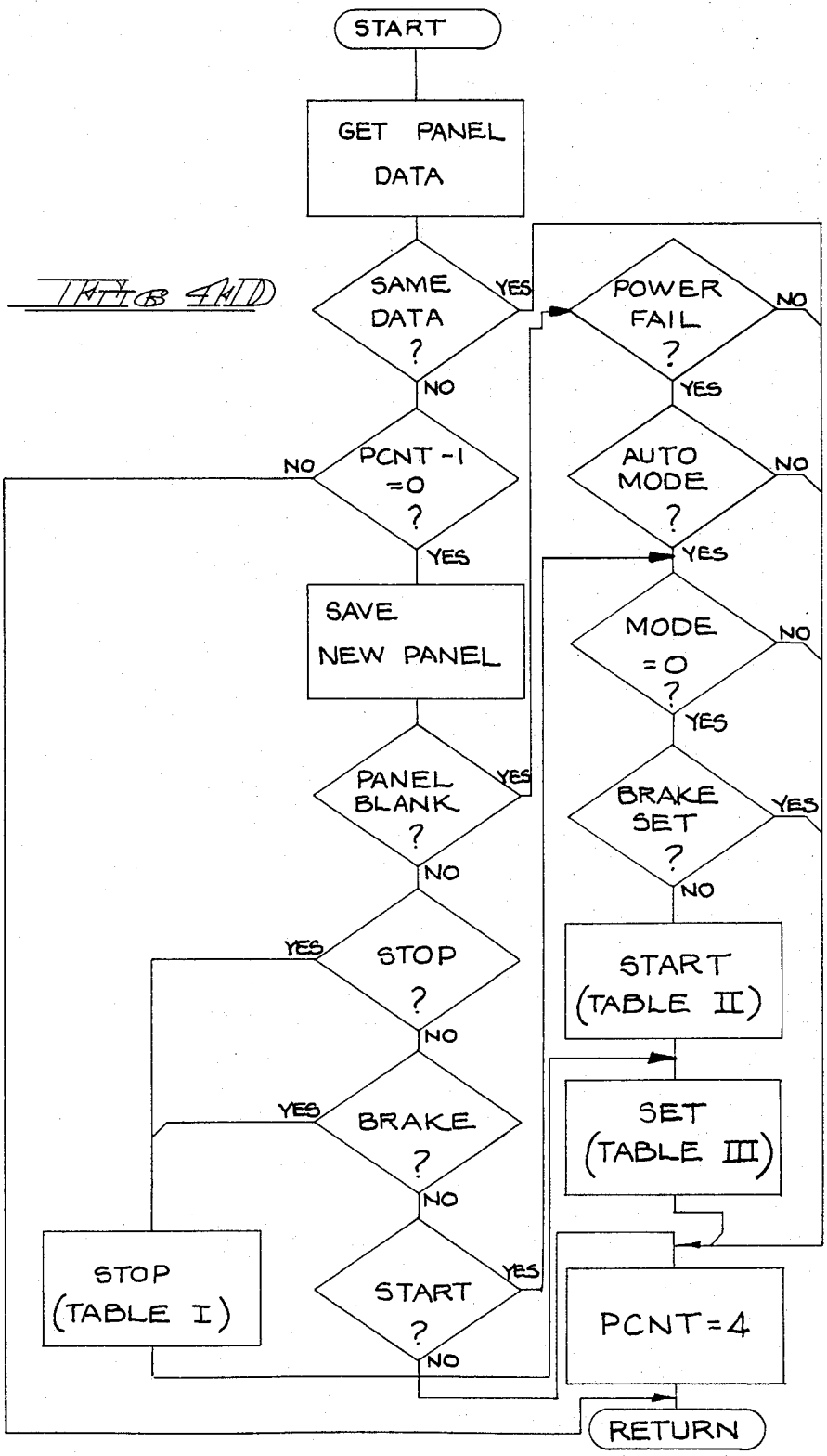
Figure 4H:
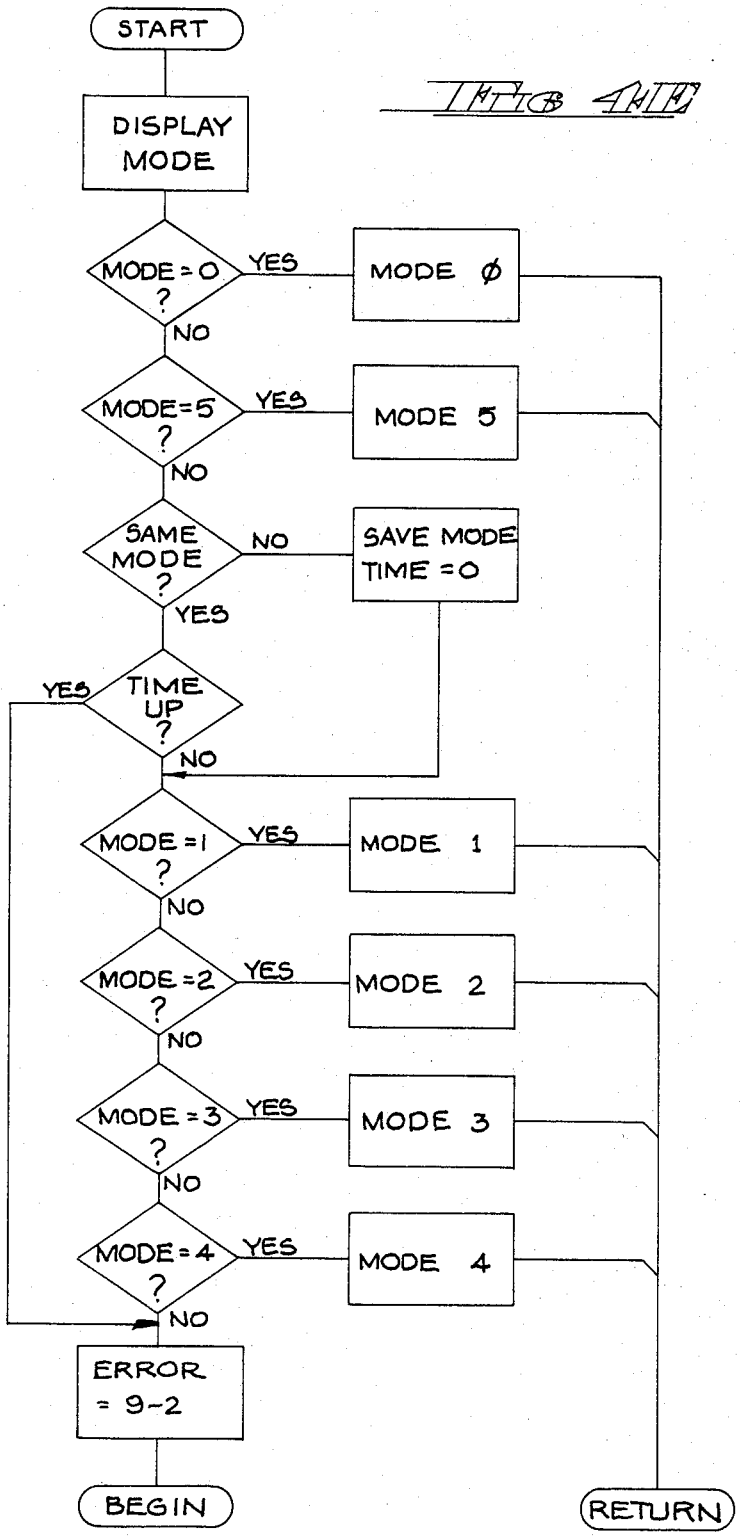
Figure 4H:
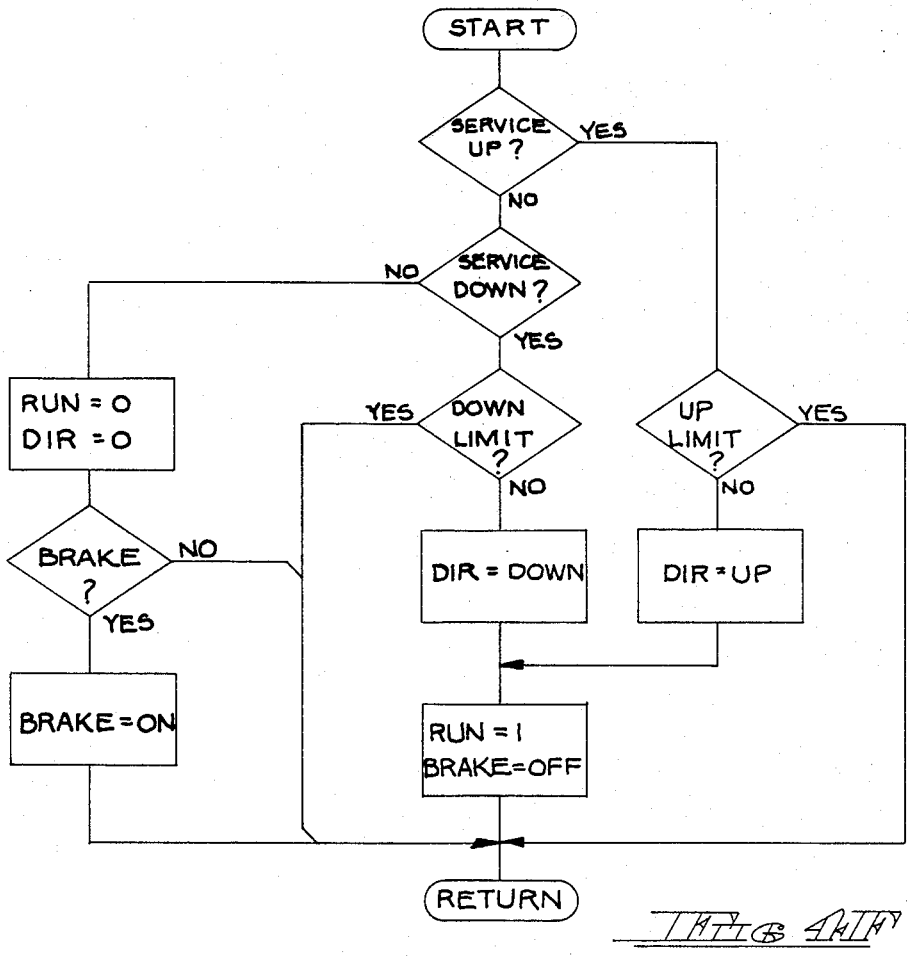
Figure 4G:
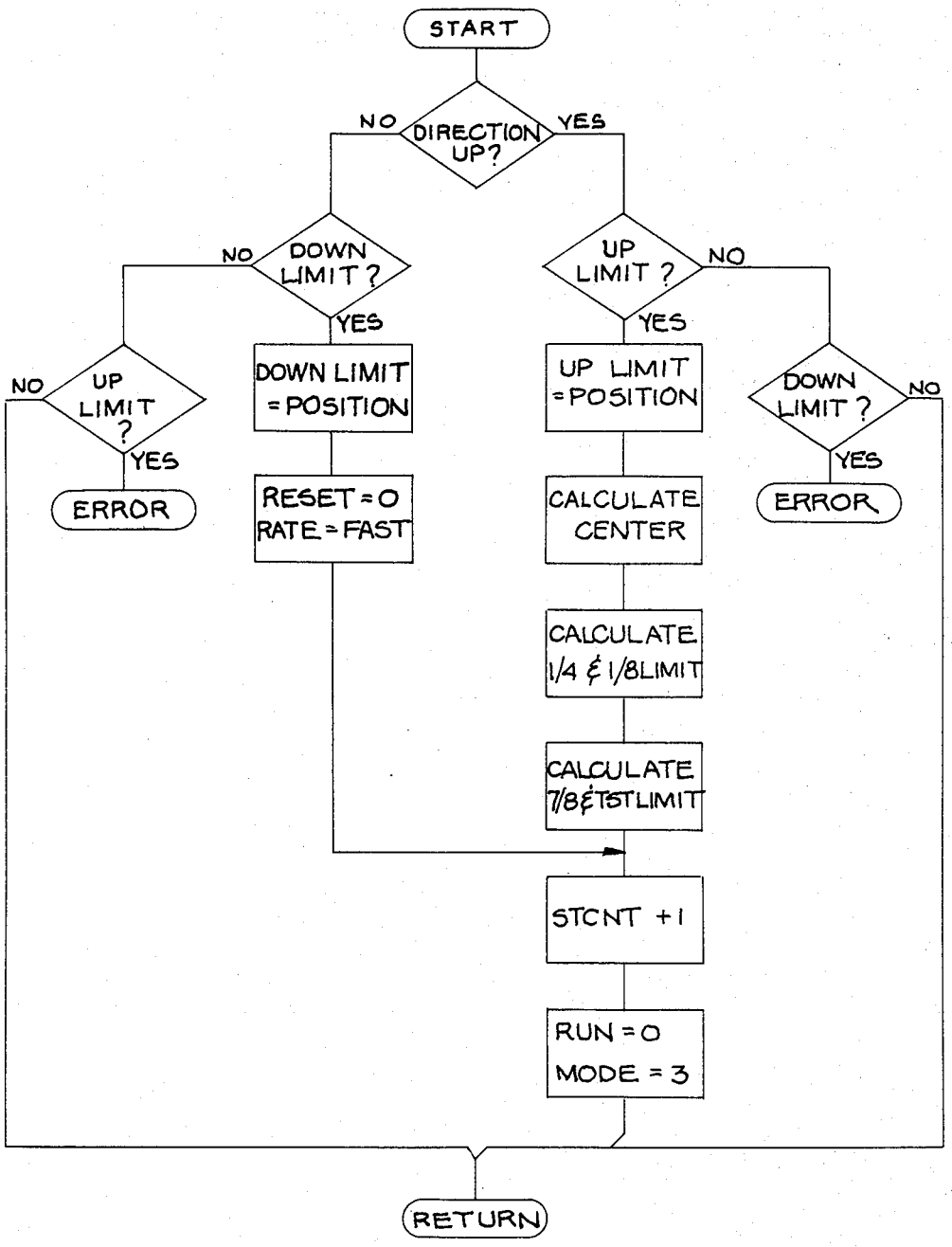
Figure 4H:
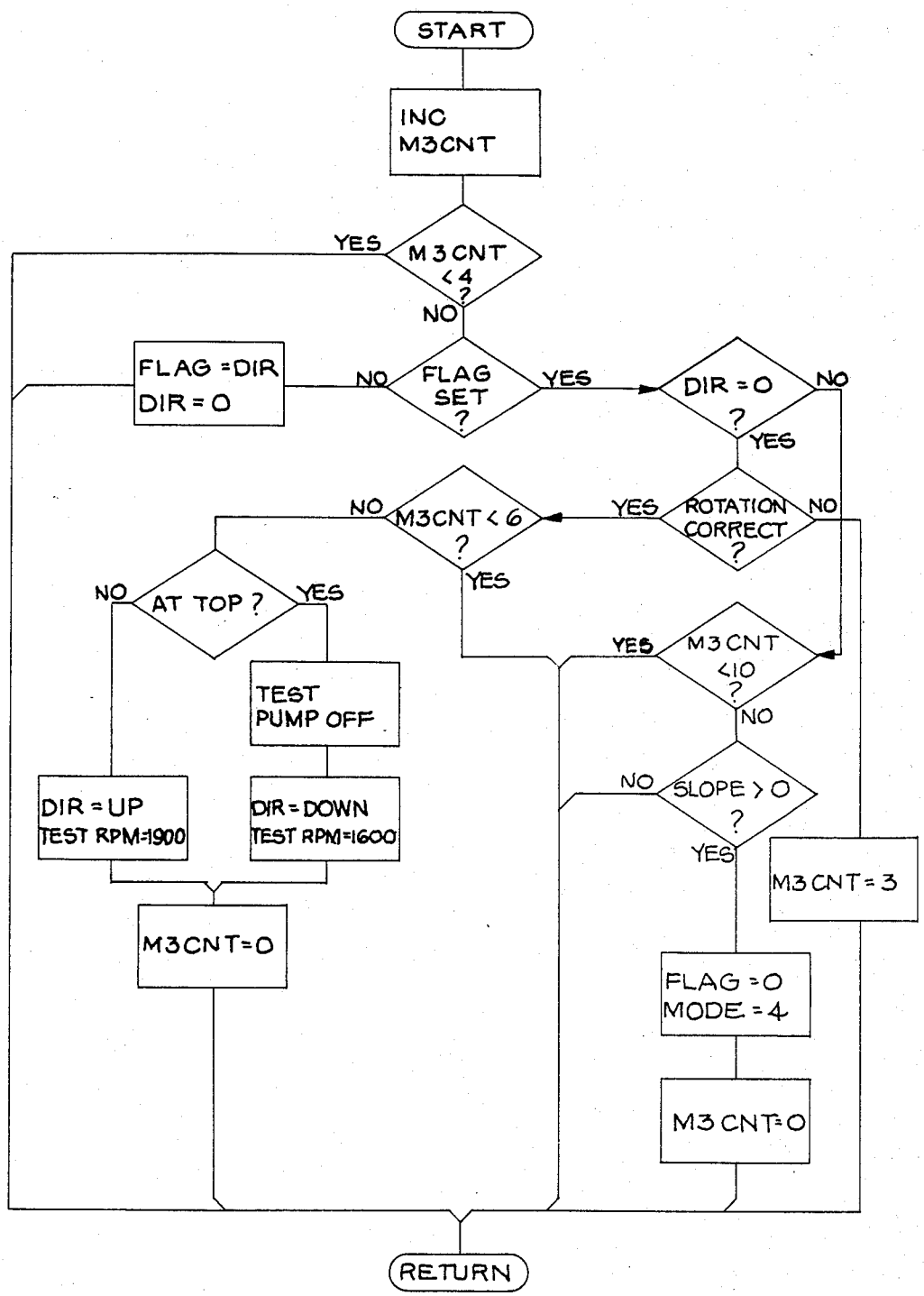
Figure 4H:
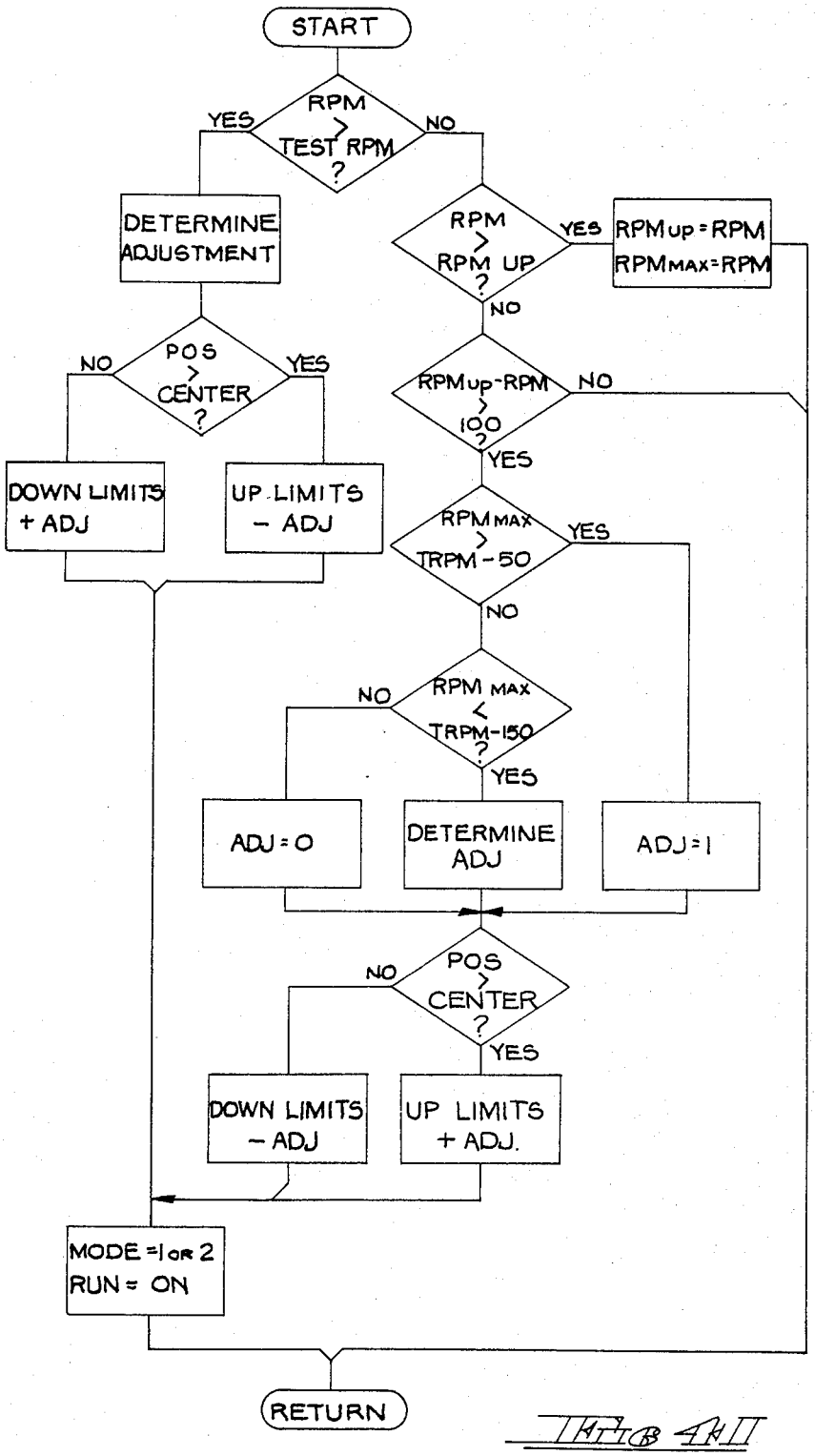
Figure 4J:
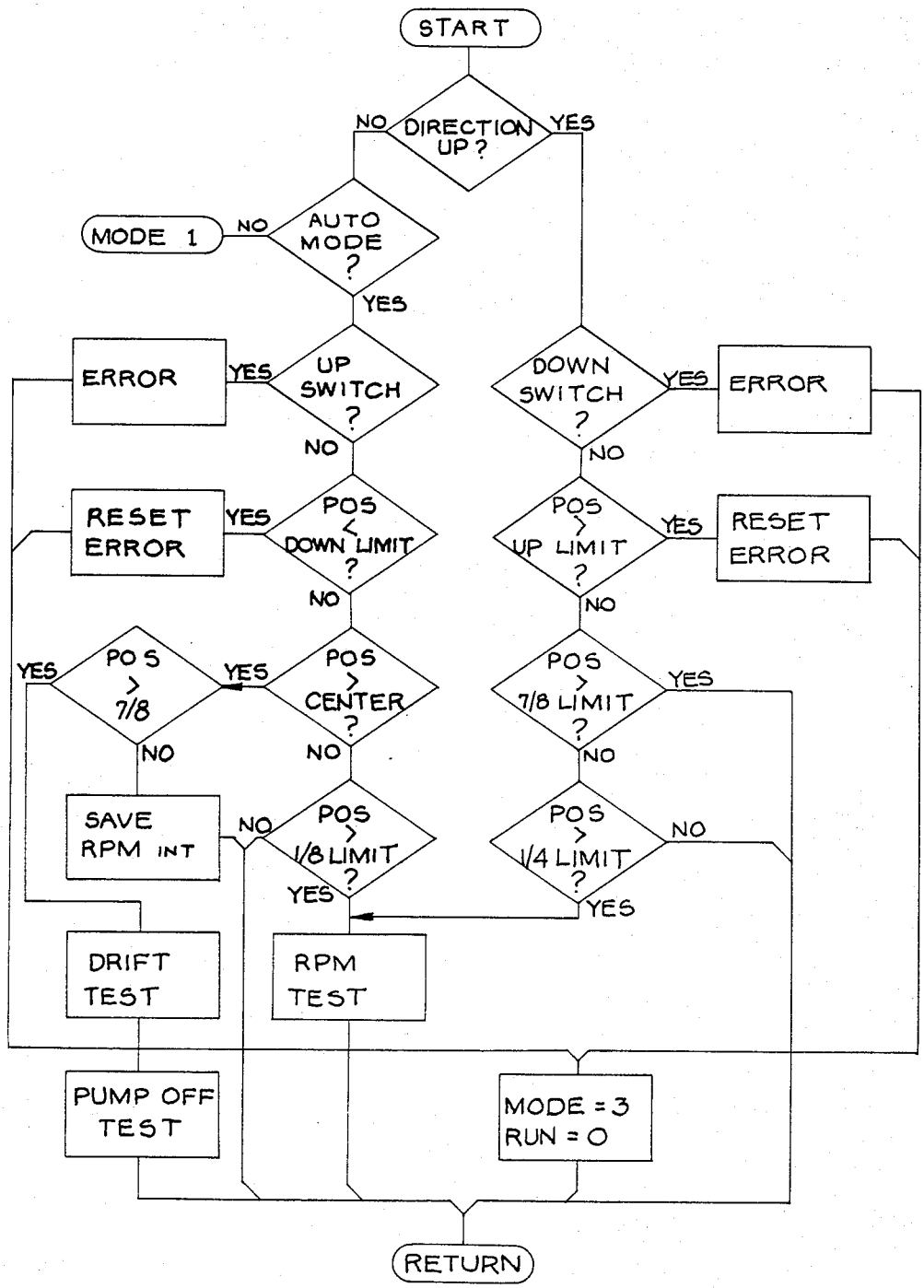
Figure 4K:
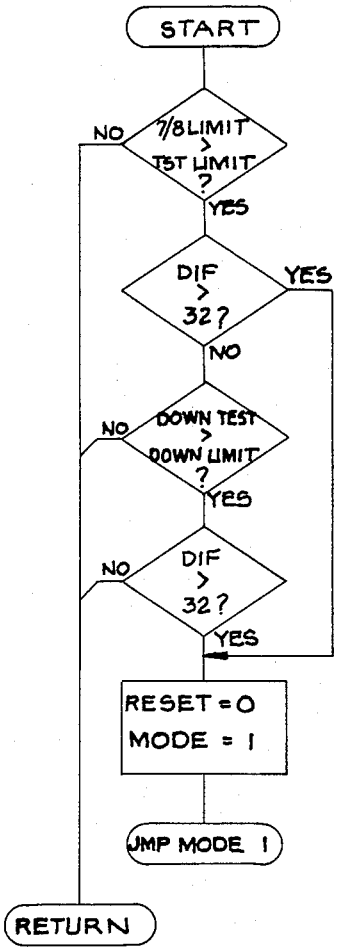
Figure 4L:
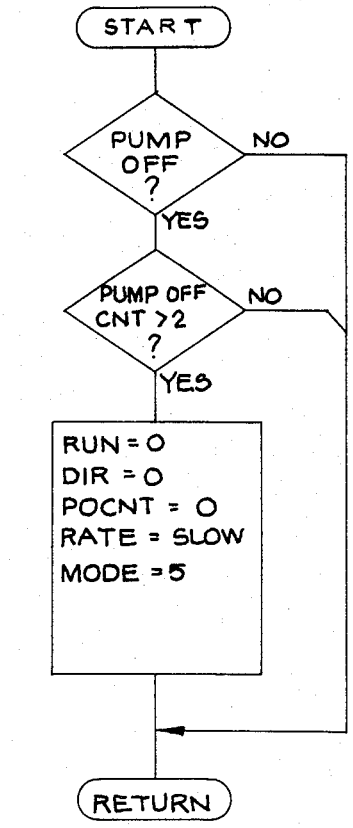
Figure 4M:
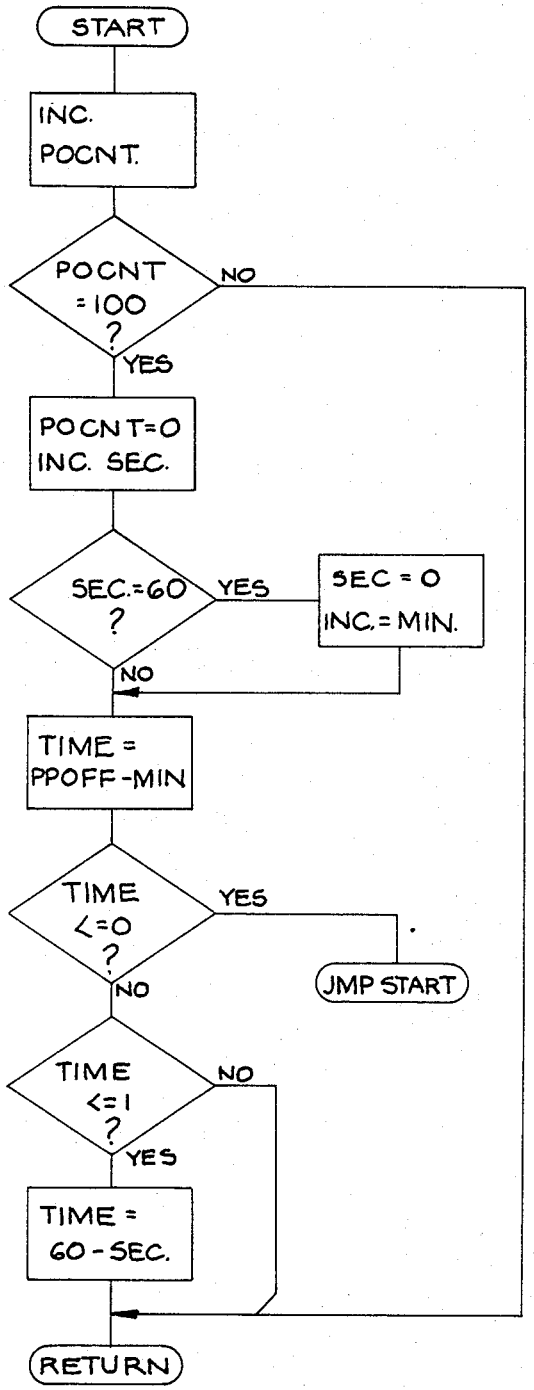
Figure 4N:
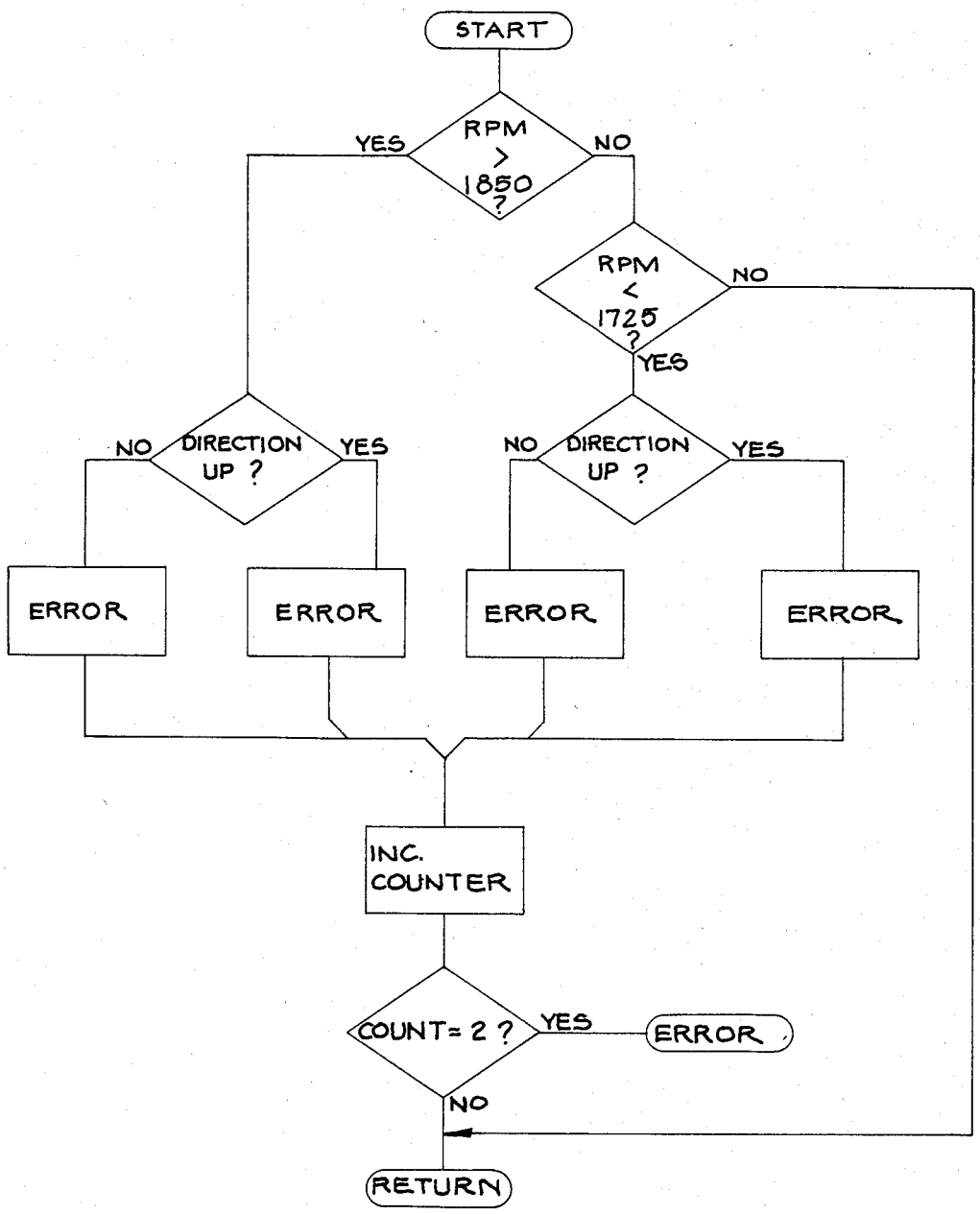

In the embodiment where control logic or processor 100 comprises a digital computer, the operation of the computer is under control of a program represented by the flow diagram of FIG. 4A–FIG. 4N. It will be understood that such a program may be physically embodied in firmware, particularly in a ROM 101 associated with control logic 100.

FIG. 4A illustrates the basic SYSTEM processing for the present invention. After initialization, the processing branches to the SERVICE INTERRUPT routine shown in FIG. 4B.

Here, input data is acquired from the various sensors associated with the system by means of the INPUT DATA routine illustrated in FIG. 4C. In the INPUT DATA program, the counter count or position signal PS is acquired from counter 17 and used to calculate the current speed of the motor. For example, this can be accomplished by calculating the change in position per unit time. If the system has not reached the end of a stroke and is not currently undergoing a direction of reversal (see the processing of MODE 3 in FIG. 4 hereinbelow), a test is made to determine if the current speed of the motor exceeds some maximum fixed figure, such as 2200 RPM. This test is made on the raw speed data to insure that the current speed of the motor is not excessive in order to protect it from mechanical failure. If the speed is found to be excessive, an error is indicated and the system is shut down.

Thereafter, the acceleration of the motor is calculated from the speed information by taking the first derivative, for example, and a stroke position reading from counter 17 is taken and stored. A test is then made to determine whether the current stroke position exceeds a previously stored stroke position by a fixed amount, such as 64. This also serves to protect the motor and system from mechancical failure, and guards against the possibility of false data acquisition. If a substantial change in position is detected, the system parameters are initialized to enter the normal start routine (MODE 1) described hereinafter. Finally, a test is made to determine whether from position information received from counter 17, the direction of rotation of the motor is consistent with the expected direction of rotation. If a descrepancy is found, an error is indicated and the system is shut down. The processing then returns to the SERVICE INTERRUPT routine of FIG. 4B.

Following the acquisition of input data as just described, a test is made to see whether a flag has been set as will be described hereinafter. This will occur if the motor has not yet been started. If this is not the case, a test is made to see whether either the upper or lower limits have been exceeded as sensed by limit switches 11 and 12 by monitoring signals LS1 and LS2. If either of these limits has been exceeded, a test is made to determine whether the temperature limits of the motor have been exceeded by attempting to drive the system against the upper or lower limit. If such is the case, the system branches to the OUTPUT data and OUTPUT test data routines to be described hereinafter. However, if the temperature limits have not been exceeded, the system immediately is stopped and the collected data is saved to prevent damage to the pump mechanism and motor.

In the event that the flag has been set or the mechanical limits have not been reached, the processing branches to the SERVICE PANEL routine described in FIG. 4D which reads the condition of the service or control panel associated with the system.

If the data is the same as collected on the previous scan, a counter PCNT is set equal to a value of 4 and the processing continues to the SERVICE MODE routine. If the data has changed, however, the PCNT counter is decremented by one and a test is made to determine if the counter equals zero. If the test is false, the SERVICE PANEL routine continues to loop and decrement until the PCNT counter is empty. The data for the service panel is then stored and a test made to determine whether certain other conditions have been met. For example, if the power has been interrupted, the data associated with the automatic reversing processing to be described hereinafter (Auto Mode) may have been lost. If the power has not failed, or the system was not in Auto Mode, a return is made. However, if the system was in Auto Mode, indicating that the data may have been lost, a test is made to determine whether the system was in the manual mode (MODE 0) to be described hereinafter. If so, a test is made to determine whether the brake has been set. If this test is negative, a path has been completed which requires initialization of the entire system. The values are then initialized according to the value set forth in Tables II and III hereinbelow.

TABLE I

| (STOP) | |
|---|---|
| RUN = | 0 |
| DIR = | 0 |
| MODE = | 0 |
| BRAKE = | off |

TABLE II

| (START) | |
|---|---|
| STCNT = | 0 |
| POCNT = | 0 |
| RESET = | true |
| M3CNT = | 0 |
| MODE = | 1 |
| RUN = | on |
| DIR = | down |

TABLE III

| FLAG = false |
|---|

If the panel is not blank, a test is made to see whether the system is in the STOP, BRAKE or START modes according to the control settings on the service panel. If the system is either in the STOP or BRAKE modes, the values in Table I and Table III are initialized. If the system is in the START mode, the processing returns to MODE 0 and follows the processing described hereinabove. Following the completion of the SERVICE PANEL routine, the processing continues to the SERVICE MODE routine described in FIG. 4E. Here, the particular mode that the system is in may be displayed on a suitable display panel, if desired. If the system is in MODE 0, the processing branches to the routine illustrated in FIG. 4F.

FIG. 4F illustrates diagrammatically the processing for manual operation of the system in order to raise or lower the pump rod U for servicing or the like. A manually operated UP switch 102 located on the service panel is used to manually drive motor M in such a direction as to raise the pump rod. If this switch has been activated (Service Up), and upper reversing switch 13 has not been activated, the function DIR is set in the up direction which activates the LS4 signal to energize coil 62, the brake is turned off, and the function RUN is set to the one state, which activates power ramping unit 52 via control line 58, thereby raising the pump rod. In the event that the upper reversing switch 13 has been activated, the power ramping unit 52 is not activated, so that the pump unit does not continue to drive into the upper limit.

A manually operated DOWN switch 103 is provided on the SERVICE PANEL to move the pump rod in the downward direction. If this switch is activated (Service Down), and the lower reversing switch 14 has not been activated, switching assembly 61 is activated via signal LS3 to drive the motor in the downward direction. At the same time, the power ramping unit 52 is activated through control line 58 and the brake is turned off. However, if the lower reversing switch 14 has been activated, the power ramping unit 52 is not activated so that the pump assembly does not continue to drive into the lower limit.

If neither the UP nor DOWN switches have been activated, the power ramping unit 52 remains deactivated and a flag is set such that the function DIR=0, i.e. LS3=0, LS4=0. A BRAKE switch 104 on the service panel is provided for activating the electromagnetically operated brake 250 by applying a signal BS. If this switch has been activated, the brake is set to hold the pump rod in a particular position. If the brake switch has not been set, the processing continues to loop as shown in an idle mode waiting for further commands.

Returning to the SERVICE MODE routine of FIG. 4E, a test is made to determine whether the system is in the MODE 5 state. This will be described in connection with the pump off operation hereinafter.

A test is also made to determine whether the system is in the same mode as during the last scan. If not, a time function is set to zero to provide the capability of indicating how long the system has been in a particular mode. If a predetermined time is exceeded, an error is indicated which shuts down the system. However, if the time has not been exceeded, the processing continues as depicted by the flow diagram of FIG. 4G.

As noted hereinabove in connection with the processing of the SERVICE PANEL routine, when the system enters the START sequence, certain tabular values are initiated. One of these actuates switching system 61 (coil 62) to initially drive the pump in the down direction when the system enters MODE 1. This insures that the pump will always be driven in a predetermined initial direction.

In the event that the pump rod U is moving in the down direction, which will be the case for the initial START sequence, at least, and the lower limit reversal 14 has been activated, the value of the position signal PS is stored which is representative of the lower limit of travel of the pump. Specific settings are also made via control line 58 which relate to the STARTROL type of power ramping unit 52 used in connection with the preferred embodiment of the present invention. If the lower reversal switch has not been activated and the upper reversal switch has been activated, an error condition is indicated which leads to shut down of the pumping system.

If the pump rod is moving in the up direction, e.g. if the count representing position signal PS from counter 17 is increasing or decreasing, the processing tests to see if the upper reversal 13 switch is activated. If not, a test is made to see if the lower reversal switch 14 has been activated. If this latter switch is unactivated, the processing returns. However, if the lower switch has been activated, indicating that the pump rod is moving in the wrong direction, an error condition is sensed which stops pump operation.

If it is determined that the pump rod is moving in the UP direction and the upper reversal switch has been reached, the value of the position signal PS at the upper limit is stored. Using this value and the value of the lower limit previously stored, the processing calculates the center point of the pump stroke, as well as $\frac{1}{8}$, $\frac{1}{4}$, $\frac{7}{8}$ stroke positions, and a test limit corresponding to the $\frac{3}{4}$ stroke position. These values are stored in memory locations.

The processing then proceeds to increment the stored count in start counter STCNT (internal to processor 100) and turns the power ramping unit 52 off. The processing then branches to the MODE 3 state described and illustrated in FIG. 4H, indicating that the end of the stroke has been reached and the pumping direction should be reversed.

In the MODE 3 routine illustrated in FIG. 4H, the MODE 3 counter M3CNT internal to processor 100 is incremented and a test made to determine whether the count is less than 4. If the count is less than 4, the processing returns to again increment the counter and test. When the status of the counter reaches a count of 4, a test is made to determine whether a flag has been set. Consequently, the first branch of the processing provides a time delay. This introduces the time period corresponding to time $t_1$ described earlier between the time the power ramping unit 52 is turned off (RUN=0) and the time the appropriate switch contacts of switching assembly 60 are deenergized (LS3=0, LS4=0). It will be observed that this time period can be varied for various types of power driving implementations.

In the event the flag has not been set, the flag is set and the switching assembly 60 is deenergized (DIR=0, LS3=0, LS4=0).

In the next pass through the loop, since the flag has been set, the processing branches to test whether DIR=0, which indicates that there has been a reversal of direction. In the present instance, since this is the case, a test is made to determine whether the actual rotation is correct. For example, if the pump rod was moving in the up direction and the motor is still coasting to a stop, the preferred direction of rotation is incorrect since it is desired to reverse the direction of pump stroke and begin movement in the downward direction. Under such a set of circumstances, the processing takes the rightmost branch illustrated in FIG. 4H and the M3CNT counter is set to a value of 3. Repeated returns through the steps just described thus gives the motor an opportunity to coast to a halt and reverse direction under the influence of the mechanical oscillatory characteristics of the pumping system. In this way, maximum benefit is derived from the mechanical energy stored in the pump system.

When it is determined that the rotation is in the proper direction, an additional delay is introduced through the test to determine if the content of the M3CNT counter is less than 6. When this condition is not satisfied, a test is made to determine whether the pump is at the top of the stroke. If not, i.e. the pump is at the bottom of the stroke, coil 64 is activated to drive the motor in the up direction, and a test value of 1900 RPM, for example, is established to be used later. The M3CNT counter is then reset and the processing returns to the SERVICE MODE subroutine of FIG. 4E.

In the event that the pump is at the top of the stroke, a test is made to determine whether the well has been pumped dry (pump off) as will be described in more detail hereinafter. Coil 62 is activated to drive the motor in the down direction, and a test RPM of 1500, for example, is established to be used at a subsequent point in the processing. It will be observed that a different test RPM is established in each of the up and down directions to compensate for the differences in mechanics of the system in each direction. It will be further understood that other values of test RPM may be established as required for a particular system.

Another branch of the processing of the MODE 3 routine occurs if DIR≠0, i.e., if either coil 62 or 64 is energized. In this case, an additional delay is introduced through the test M3CNT<10. When this condition has been satisfied, the slope of the motor speed curve is examined to determine whether the motor is still accelerating in the same direction by using the dv/dt information established in the INPUT DATA subroutine. If the slope is greater than zero, indicating that the motor is still accelerating, a return is made in the processing. However, if this condition is true, indicating that the motor has stopped accelerating, the flag established earlier is cleared, the M3CNT counter is reset, and the processing branches to the MODE 4 subroutine which causes the motor to start in the opposite direction.

The processing of MODE 4 is illustrated in the flow diagram of FIG. 4I, and is designed to turn on motor M when its speed either exceeds a preset speed or the speed peaks. This insures that the motor is turned on at the optimum point taking into account the mechanical characteristics of the entire system and utilizing, to the greatest extent possible, the potential energy stored in the moving components.

A test is first made to determine whether the speed of the motor exceeds the test speed established in the MODE 3 processing. As noted, the test speed will be different depending on whether the pump is moving in the up or down direction to take into account the different dynamic mechanical characteristics. In either case, at this point, the motor is being driven by stored energy.

If the actual speed has exceeded the test speed, indicating that adjustment is necessary to reduce the stroke, the left-hand branch in FIG. 4I is followed. In normal operation, it will be understood that the motor is operated until it either activates the upper or lower reversal switch or reaches a certain count indicative of the reversal position as stored earlier in the processing in the MODE 1 routine. In other words, if the system is running in the automatic mode where the reversal point is determined by a stored number corresponding to the desired turn-around position, rather than by activation of the reversal switches, it is desirable to adjust the turn-around point by lowering the stored position value so that the motor reverses at an earlier point thereby bringing the actual speed of the motor and the test speed of the motor into equivalence. It should also be observed that if the motor is running optimally, the left-hand branch in the MODE 4 processing will never be taken, since adjustment will not be necessary.

Following the determination of the amount of adjustment necessary, a test is made to determine whether the instantaneous position is above or below the center point of stroke travel, i.e. whether the motor has reversed at the upper or lower turn around point. This center position was calculated earlier in the MODE 1 processing. Depending upon the position of the motor, the upper or lower reversal point is adjusted to provide a more optimal start point. In either event, the power ramping unit 52 via control line 58 is energized to restart the motor, and the processing branches to MODE 1 or MODE 2 depending upon whether the system is being operated in the automatic or manual modes. In the manual mode, reversal of the motor is determined by physical activation of the reversal switches as previously described in connection with the processing of MODE 1. In the automatic mode, reversal of the motor is under automatic control of the calculated reversal points just described as set out in more detail in the MODE 2 processing to be described hereinafter.

Returning to the MODE 4 processing of FIG. 4I, in the event that the actual speed of the motor is not greater than the test speed, the right-hand branch is followed. A test is then made to determine whether the speed is still increasing. The values of the motor speed are updated and the processing returns. In the event that the motor speed has reached a peak, a test is made to determine whether the last two successive readings of motor speed differ by more than some predetermined amount, such as 100 RPM. This eliminates the possibility of noise or extraneous signals associated with the speed data from causing a false indication. If this condition is true, the system is committed at this point to start the motor.

The stored value of maximum motor speed is then compared with the stored test motor speed for that particular motor rotation direction reduced by some small fixed amount, such as 50 RPM. Again, this adjustment is made to add some hysteresis to the system. If this condition is true, the calculated reversal position of the motor is adjusted by one unit in order to reduce the stroke of the pump. If the maximum motor speed is not greater than the adjusted test speed, a further determination is made whether the difference is less than or greater than 150 RPM. If this is true, the amount of adjustment necessary is calculated as described earlier for the left-hand branch of the MODE 4 processing. If the difference between the stored maximum motor speed and the test speed lies within the range 50–150 RPM, for example, no adjustment will be made.

In each case, a test is then made to determine whether the pump rod is at the upper or lower reversal limit, and an appropriate adjustment is made to that reversal point. The system then continues to the processing of MODE 1 or MODE 2 as previously described.

The MODE 2 processing, illustrated in FIG. 4J, calculates the automatic optimum reversal points. It is similar in operation to the processing of MODE 1 which relies on reversal for physical activation of the reversal switches, and acts to establish a correlation between the reversal switches and the internal counter storing the calculated value of reversal position.

A test is first made to determine whether the motor is moving in the up or down direction. If the motor is moving downwardly, a test is made to determine whether the system is in the automatic mode, as might be determined by a switch on the service panel on the pump control. If the system is in the manual mode, the processing branches to MODE 1. If the system is in the automatic mode, a test determines whether the upper reversal switch 13 has been activated. If such is the case, an error condition is indicated, the power ramping unit 52 is disabled (RUN=0), and the processing branches to MODE 3 to prepare for motor reversal. If such a condition does not exist, a test is made to see whether the value of reversal position stored has exceeded the value of the lower limit. That is, if the value of reversal position has been reached before physical activation of lower reversal switch 14 has occurred. If such is the case, the error just described is reset and the system branches to the MODE 3 processing and the power ramping unit 52 is disabled to prepare for motor reversal. It should be noted that the reversal switches will not be activated if the system is running optimally.

However, if this limit has not been reached, a test is then made to determine whether the position is greater than center; that is, if the pump is still in the upper portion of the stroke. If this test is true, an additional test is made to determine whether the position is greater than seven-eighths of the total stroke, using a value calculated during the MODE 1 routine. If the position is less than seven-eighths of the full stroke, the motor speed at this point is stored for use in the pump off test as will be described hereinafter. If the position is greater than seven-eighths of the full stroke the processing branches to the DRIFT TEST routine illustrated in FIG. 4K.

The DRIFT TEST routine is designed to assure that the count established for the reversal points does not change by an exaggerated amount between successive pump strokes. In the particular processing shown, the maximum permissible deviation is fixed at a count of 32. However, it will be understood that other limits may be placed on the permissible deviation. In the event that the difference is determined to be greater than 32, the processing branches to mode 1 to operate between reversal points established by reversal switches 13 and 14 for several cycles before returning to the automatic mode of operation wherein the reversal points are established by a stored count.

Following the DRIFT TEST routine, the processing continues with the PUMP OFF TEST routine illustrated in FIG. 4L, which establishes system operation in the event the well has been pumped dry.

A pump off condition is indicated when the downstroke motor speed exceeds a predetermined stored value for a specified number of strokes. In the exemplary embodiment illustrated, a pump off condition will be indicated when the overspeed condition persists for two successive strokes, whereupon the pump will be shut down. Under this condition, the power ramping unit 52 and switching circuit 60 are deenergized (RUN=0, DIR=0), and the processing branches to the MODE 5 subroutine illustrated in FIG. 4M. At the same time, appropriate input signals (RATE=slow) are provided over control line 58 to the STARTROL type of power ramping unit 52 illustrated in the preferred embodiment described herein.

The MODE 5 subroutine will be maintained as long as a pump off condition exists. Initially, the pump off counter is incremented and a test made to determine whether the count has reached 100, i.e., the pump off counter will count seconds and minutes (e.g. 100 scan cycles) until the elapsed time equals that programmed by the operator (PPOFF). After the desired time has elapsed, the pump will restart and the system will monitor motor speed to determine if a pump off condition exists. In other words, the operator may program any desired time (PPOFF) at which the pump will attempt to restart and reaccess whether the pump off condition has abated. If the system is no longer in a pump off condition, the starting sequence described hereinabove will be initiated. However, if a pump off condition still exists, the system processing will revert to the PUMP OFF TEST subroutine and the MODE 5 routine.

Returning to the MODE 2 routine of FIG. 4J, in the event that the position of the stroke is within the lower $\frac{1}{8}$ interval, the RPM TEST routine shown in FIG. 4N is entered. This routine is designed to determine if the motor is overloaded in either direction. A test is first made to see whether the motor is in an overspeed condition where it is actually acting as a generator because of the motor's inability to control the particular load encountered. In the particular embodiment shown, an over-speed condition is indicated by a motor speed greater than 1850 RPM. If this is the case, a determination is made in which direction the motor is moving, and an appropriate error condition is signaled. If the condition persists for more than two cycles, the system is shut down to avoid mechanical damage.

If the motor is overloaded, represented by a speed of less than 1725 RPM, an appropriate error display is provided and the system is shut down if the condition persists for more than two pump cycles.

Returning to the MODE 2 routine of FIG. 4J, if the motor is moving in the up position and the lower reversal switch has been activated, an error condition is indicated in a manner similar to that described hereinabove. If the upper reversal switch has been activated without reaching the pre-established reversal position count, an error also is indicated. Finally, when the position of the motor is between the $\frac{1}{4}$ and $\frac{7}{8}$ positions on the upstroke, the RPM TEST routine is initiated as described hereinabove. This completes the MODE 2 processing.

Returning to the SERVICE INTERRUPT routine of FIG. 4B, OUTPUT DATA and OUTPUT TEST DATA may be used to output the system information to various display and/or monitor devices, as required.

In summary, the control of the present invention permits dynamic changes to be made to the operating parameters of the pumping system, particularly the motor speed and reversal points, to optimize the power required by the motor over a wide range of operating conditions. In the automatic mode of operation, the reversal points are continually updated based on the load encountered by the motor, to insure that maximum advantage is taken of the inherent stored energy of the mechanical components of the system. Furthermore, the system is continuously monitored for faults which could lead to damage of the mechanical or electrical components.

It will be understood that various changes in the details, materials, steps and arrangements of parts, which have been herein described and illustrated in order to explain the nature of the invention, may be made by those skilled in the art within the principle and scope of the invention as expressed in the appended claims.

The embodiments of the invention in which an exclusive property or privilege is claimed are as follows:

1. In an oscillatory pumping system of the type having a pumping member reciprocably slidable within a well bore, a counterbalance member connected to said pump member for at least partially counterbalancing the weight of the pump member to affect an oscillatory action, means for reciprocating said pumping member in upward and downward stroke directions comprising a pump cycle wherein the pump member is moved cyclically in an upward direction to a top stroke position and in a downward direction to a bottom stroke position, and a reversible electric motor for operating said reciprocating means, the improvement in combination therewith comprising control system means for applying power to and removing power from the motor at optimally determined points during the pumping cycle so as to minimize motor peak load current requirements including:

sensing means for establishing at one or more points during the pumping cycle and for a plurality of cycles, values representative of pump member movement;

means for continually calculating from said established values a first reference position in said pump cycle including means for applying power to the motor when the pump member reaches said first position and is moving in the upward direction at a point following pump member reversal at the bottom of its stroke so as to smoothly accelerate the motor to synchronous speed and to continue pump member movement in the upward direction;

first means for removing power from the motor before the pumping member reaches the top of its stroke so that the pump member reverses direction and begins moving in the downward direction;

means for continually calculating from said established values, a second reference position in said pump cycle including means for applying power to the motor when the pumping member reaches said second position and is moving in a downward direction at a point following pump member reversal at the top of its stroke so as to smoothly accelerate the motor to synchronous speed and to continue pump member movement in the downward direction; and second means for removing power from the motor before the pumping member reaches the bottom of its stroke so that the pump member reverses direction and begins moving in the upward direction, said first and second calculated reference positions being chosen so as to minimize the motor peak load current when power is applied to the motor.

2. The pumping system according to claim 1 wherein said first power removing means includes upper reversal switch means responsive to pump member travel at an upper stroke position for activating said first power removal means, and lower reversal switch means responsive to pump member travel at a lower stroke position for activating said second power removing means.

3. The pumping system according to claim 1 wherein said sensing means comprises means for sensing motor speed, said established values comprising values of motor speed.

4. The pumping system according to claim 1 wherein said sensing means includes means for sensing the direction of rotation of the motor and means for disabling pumping system operation if the actual direction of rotation is different from the expected direction of rotation.

5. The pumping system according to claim 1 wherein said power applying means includes means for gradually applying power to the motor when the pumping member reaches said calculated reference positions.

6. The pumping system according to claim 1 wherein said calculating means comprises memory means for storing a program defined by a plurality of sequentially executable instructions for controlling said control system means operation and a microprocessor responsive to said instructions.

7. The pumping system according to claim 6 wherein said sensing means comprises means for sensing the position of the pump member, said established values comprising values of pump member position, and said calculating means includes means for calculating the actual speed of said motor from said pump member position values.

8. The pumping system according to claim 7 wherein said calculating means further includes means for determining when the motor speed has peaked following pump member reversal and means responsive to said motor speed peak determining means for calculating said first and second reference positions.

9. The pumping system according to claim 8 wherein said first power removing means includes upper reversal switch means responsive to pump member travel at an upper stroke position for actuating said first power removal means, and lower reversal switch means responsive to pump member travel at a lower stroke position for activating said second power removing means.

10. The pumping system according to claim 9 wherein said calculating means includes means for storing position values from successive pumping cycles, means for comparing said stored values, and means for disabling pumping system operation if said stored position values differ by a predetermined amount, means responsive to motor speed for disabling pumping system operation in the event motor speed exceeds a predetermined overspeed value, means for sensing the direction of rotation of the motor and for disabling pumping system operation if the actual direction of rotation is different from the expected direction of rotation, said calculating means operating to calculate said first and second reference positions when the motor speed exceeds a predetermined test motor speed value following pump member reversal or when said motor speed peaks, whichever occurs first, said calculating means operating to adjust the calculated reference positions only if said peak motor speed and said test motor speed differ by a predetermined amount, the test motor speed value in the upward direction being greater than the test motor speed value in the downward direction.

11. The pumping system according to claim 10 including means for disabling pump operation in the event motor speed, when the pump member is moving in the downward direction, exceeds a predetermined value for a predetermined number of cycles or wherein motor speed measured adjacent the stroke reversal points lies outside a predetermined range of speed values, said power applying means including means for gradually applying power to the motor when the pumping member reaches said calculated reference positions.

12. The pumping system according to claim 1 wherein said sensing means comprises means for sensing the position of the pump member, said established values comprising values of pump member position.

13. The pumping system according to claim 12 including means responsive to said position sensing means for calculating an upper stroke reference position, means for activating said first power removal means when the pump member reaches said upper stroke reference position, means responsive to said position sensing means for calculating a lower stroke reference position and means for activating said second power removing means when said pump member reaches said lower stroke reference position.

14. The pumping system according to claim 12 wherein said calculating means further includes means for storing position values from successive pumping cycles, means for comparing said stored values, and means for disabling pumping system operation if said stored position values differ by a predetermined amount.

15. The pumping system according to claim 12 including means for disabling pump operation in the event motor speed when the pump member is moving in the downward direction exceeds a predetermined value for a predetermined number of cycles.

16. The pumping system according to claim 12 including means for disabling pumping system operation in the event of an overload condition wherein motor speed measured adjacent the stroke reversal points lies outside a predetermined range of speed values.

17. The pumping system according to claim 12 wherein said calculating means includes means for calculating the actual speed of said motor from said pump member position values.

18. The pumping system according to claim 17 wherein said position sensing means comprises a tachometer associated with said reciprocating means for producing electrical signals representative of pump member movement, and counter means responsive to said electrical signals for establishing a count representative of pump member position.

19. The pumping system according to claim 17 including means for sensing motor speed and means responsive to said speed sensing means for disabling pumping system operation in the event motor speed exceeds a predetermined overspeed value.

20. The pumping system according to claim 17 wherein said calculating means comprises means for determining when the motor speed has peaked following pump member reversal and means responsive to said motor speed peak determining means for calculating said first and second reference positions.

21. The pumping system according to claim 20 wherein said calculating means operates to calculate said first and second reference positions when the motor speed exceeds a predetermined test motor speed value following pump member reversal or when said motor speed peaks, whichever occurs first.

22. The pumping system according to claim 21 wherein said calculating means includes means for determining the peak motor speed value following pump member reversal and means for adjusting the calculated reference position only if said peak motor speed and said test motor speed differ by a predetermined amount.

23. The pumping system according to claim 21 wherein the test motor speed value when the pump member is moving in the upward direction is greater than the test motor speed value when the pump member is moving in the downward direction.

* * * * *